US011561055B2

(12) United States Patent
Kirstein

(10) Patent No.: US 11,561,055 B2
(45) Date of Patent: Jan. 24, 2023

(54) SEMIAUTOMATIC OR FULLY AUTOMATIC FIREARM

(71) Applicant: Gerhard Kirstein, Augsburg (DE)

(72) Inventor: Gerhard Kirstein, Augsburg (DE)

( * ) Notice: Subject to any disclaimer, the term of this patent is extended or adjusted under 35 U.S.C. 154(b) by 0 days.

(21) Appl. No.: 17/458,689

(22) Filed: Aug. 27, 2021

(65) Prior Publication Data

US 2022/0065564 A1 Mar. 3, 2022

(30) Foreign Application Priority Data

Aug. 28, 2020 (DE) ..... 10 2020 005 301.7

(51) Int. Cl.

| | |
|---|---|
| ***F41A 1/10*** | (2006.01) |
| ***F41A 3/26*** | (2006.01) |
| ***F41A 3/46*** | (2006.01) |
| *F41A 3/66* | (2006.01) |

(52) U.S. Cl.

CPC ..... *F41A 3/26* (2013.01); *F41A 3/46* (2013.01); *F41A 3/66* (2013.01)

(58) Field of Classification Search

CPC ..... F41A 3/12; F41A 3/54; F41A 3/56; F41A 7/06; F41A 1/10

See application file for complete search history.

(56) References Cited

U.S. PATENT DOCUMENTS

| | | | | |
|---|---|---|---|---|
| 5,140,892 | A | 8/1992 | Koine | 89/7 |
| 2011/0239852 | A1 | 10/2011 | Kirstein | 89/180 |
| 2012/0137870 | A1* | 6/2012 | Lindsay | F41A 1/10 42/1.06 |
| 2021/0025669 | A1* | 1/2021 | Griffin | F41C 23/06 |
| 2022/0065564 | A1* | 3/2022 | Kirstein | F41A 3/46 |

FOREIGN PATENT DOCUMENTS

| | | | |
|---|---|---|---|
| DE | 32 08 941 | A1 | 9/1983 |
| DE | 38 05 621 | A1 | 11/1991 |
| DE | 10 2004 021 952 | B3 | 12/2005 |
| DE | 10 2007 063 292 | B3 | 5/2009 |
| DE | 10 2016 004 678 | A1 | 10/2017 |
| WO | WO 2018/019621 | A1 | 2/2018 |

OTHER PUBLICATIONS

Office Action dated Apr. 8, 2021 in corresponding German Patent Application No. 10 2020 005 301.7.

* cited by examiner

*Primary Examiner* — J. Woodrow Eldred
(74) *Attorney, Agent, or Firm* — Ostrolenk Faber LLP

(57) ABSTRACT

A semiautomatic or fully automatic firearm that includes a barrel, the rear barrel end whereof is in the form of a cartridge chamber into which a cartridge can be inserted, a breech body which is arranged such that it can move in the longitudinal direction between an open position, which releases the cartridge chamber for the reloading of a cartridge, and a closed position which closes the cartridge chamber, wherein the breech body closes the cartridge chamber at the rear in the closed position and is used as a support for the cartridge case of the cartridge, wherein the firearm has a mass simulation body which is in force-fitting engagement with the breech body, in particular a mass simulation body which is rigidly connected to the breech body, the mass simulation body being formed at least in part from a magnetizable or a magnetic material.

19 Claims, 4 Drawing Sheets

SEMIAUTOMATIC OR FULLY AUTOMATIC FIREARM

CROSS-REFERENCE TO A RELATED APPLICATION

The present application claims priority to German Patent Application No. 10 2020 005 301.7, filed Aug. 28, 2020, the content of which is incorporated by reference herein.

TECHNICAL FIELD

The invention relates to a semiautomatic or fully automatic firearm.

BACKGROUND OF THE INVENTION

DE 10 2004 021 952 B3 discloses an example of a self-loading handheld firearm.

Firearms of this kind, or similar, use the recoil produced when the weapon is fired to move a breech body from a closed position into an open position for reloading. However this movement of the breech body cannot take place too early while the shot is being fired, or after it has been fired, as the resulting pressure is intended to be used first to accelerate the fired projectile. Only when the projectile has reached a given speed should the breech body be moved from its closed position into its open position. In order to guarantee this, many weapons have a breech lock which locks the breech body in the closed position until a predefined point in time has been reached.

Other automatic firearms do not have a breech lock. The breech body in this case should have a high mass (and therefore a high mass inertia), in order to withstand the recoil force of the projectile and the recoil forces of the hot gases from the propellant charge of the projectile for a desired period of time. A high material mass makes the firearm heavy. For reasons associated with the movability of the parts and the comparatively high mass of the breech, the aiming accuracy of automatic firearms is normally not as good as that of repeater rifles.

In order to solve this problem, DE 10 2007 063 292 B3 discloses a semiautomatic or fully automatic firearm in which two or more permanent magnets, or a permanent magnet and a material accumulation corresponding thereto made up of ferromagnetic or ferromagnetic material are provided, the magnetic field whereof forces the breech body at least in the closed position, and in positions close to the closed position, into the closed position so that the magnetic force of the permanent magnets simulates a higher mass, referred to below as an effective mass, of the breech body, which acts as an opposing bearing or counter support or support during the firing of a projectile. The permanent magnets disposed for mutual attraction are arranged so as to be rotatable relative to one another about a center axis which is aligned with the axial bore axis of the barrel, so that the mutually attracting permanent magnets are rotatable relative to one another between a first rotation angle position in which a north pole is aligned with a south pole and a second rotation angle position in which the north pole is not aligned, or is less aligned, with the south pole, so that the magnetic attractional force between the poles can be reduced by rotation. This allows a relatively low-force opening of the breech body.

However, this design requires an increase in the number of components inside the weapon compared with a traditional weapon, and also a high degree of precision in the production of the weapon.

SUMMARY OF THE INVENTION

Starting with the prior art as explained above, the problem addressed by the present invention is that of specifying a firearm which guarantees a high effective mass of the breech of the weapon in a structurally simple manner.

The problem addressed by the invention is solved in relation to its mechanistic aspects by a firearm having the features disclosed herein.

The problem addressed by the present invention is therefore solved by a semiautomatic or fully automatic firearm comprising a barrel, the rear barrel end whereof is in the form of a cartridge chamber into which a cartridge can be inserted, and a breech body which is arranged such that it can move in the longitudinal direction between an open position, which releases the cartridge chamber for the reloading of a cartridge, and a closed position which closes the cartridge chamber, wherein the breech body closes the cartridge chamber at the rear in the closed position and is used as an opposing bearing or counter support or support for the cartridge case of the cartridge. The firearm has a mass simulation body which is in force-fitting engagement with the breech body, in particular a mass simulation body which is rigidly connected to the breech body and is formed at least in part from a magnetizable or a magnetic material, in particular a ferromagnetic, ferrimagnetic or permanent-magnetic material. The firearm furthermore has an arrangement of one or multiple electromagnets, wherein the mass simulation body is arranged in the effective region of the magnetic field/magnetic fields of the electromagnet(s). In other words, the mass simulation body and the electromagnet or electromagnets are arranged in such a manner that in a state in which at least one electromagnet produces a magnetic field, the body is attracted by the magnetic field of the electromagnet(s) or is possibly also rejected or repelled.

In a possible embodiment, the firearm comprises multiple electromagnets, wherein said electromagnets are arranged linearly in the manner of a BLDC linear stator. This guarantees an increase in the effective mass of the breech body with geometrically, and therefore structurally, simple conditions.

In a further possible embodiment, the firearm comprises multiple electromagnets and the mass simulation body is formed at least in part from a magnetic, in particular, permanent-magnetic material, wherein the mass simulation body and the multiple electromagnets form a BLDC linear motor or are arranged in the manner of a BLDC linear motor. In this way, through a corresponding activation or energizing or the power supply to the magnets, a movement of the mass simulation body, and therefore of the breech body connected thereto, can take place in a desired direction by virtue of the magnetic fields produced by means of the electromagnets.

Optionally, the mass simulation body has a plate-shaped or rod-shaped design with at least one flat side which faces the at least one electromagnet, in particular the plurality of electromagnets.

In one possible embodiment, the firearm has an elastic element for moving the breech body from the open position into the closed position, in particular in the form of a closing spring. This means that a reliable and structurally simple reloading action is guaranteed. In addition, or as an alternative to this, the firearm may have an open-loop or closed-loop control which is designed to supply power to each electromagnet individually and independently of the other electromagnets in each case in terms of timing, in particular in such a manner that the mass simulation body is moved in the closing direction, in particular into the closed position, by the resulting magnetic fields.

A sliding element may be arranged between the mass simulation body and the at least one electromagnet. This enables the sliding friction during a movement of the breech body and mass simulation body to be overcome more easily.

The firearm may, in addition, comprise one or multiple position sensors for detecting the position of the mass simulation body. These are particularly provided for detecting that the mass simulation body is in a position in which the breech body of the firearm is in its closed position, and for detecting that the mass simulation body is in a position in which the breech body of the firearm is in its open position. In this way, breech body positions or, to be more precise, mass simulation body positions, and therefore also breech body positions which are important for an energization or supply of power to the electromagnet(s) can be easily and reliably detected.

The firearm optionally has an open-loop or closed-loop control which is designed to adjust a maximum power supply to the one, or at least one, in particular to all, of the multiple electromagnets when the breech body is in the closed position for a given period of time. In this way, when a shot is fired, a high effective mass of the breech body can be achieved.

In addition or alternatively, the firearm may have an open-loop or closed-loop control which is designed to adjust a maximum power supply to the one, or at least one, in particular to all, of the multiple electromagnets when the breech body is in the open position for a given period of time. In this case, the barrel can be effectively ventilated and cooled.

In addition or alternatively, the firearm may have an open-loop or closed-loop control which is designed to adjust a fraction, in particular a predetermined fraction (for example 5% to 40%, in particular 5% to 25%, furthermore in particular 5% to 15%, once again furthermore in particular 10%) of the maximum power supply to the one, or at least one, in particular to all, of the multiple electromagnets for a given period of time, in particular during a period of time of a movement of the breech body from its open position into its closed position.

Again in addition, or alternatively, the firearm may have an open-loop or closed-loop control which is designed to adjust a power supply to the one, or at least one, in particular to all, of the multiple electromagnets for the demagnetization of the arrangement, in particular the arrangement of electromagnet(s) and the mass simulation body.

In one possible embodiment, the firearm has a firing pin and an open-loop or closed-loop control designed to activate the one or multiple electromagnets depending on the position of the firing pin, which leads to a possibility of precision control of the power supply or energization of the electromagnet(s), in particular for the firing of shots (high effective mass of the breech body).

If the firearm has multiple electromagnets, the power supply thereto is optionally provided, or designed, for an AC supply, which allows a magnetic-field-induced movability of the mass simulation body, in the event that said mass simulation body is made of permanent magnets or permanent-magnetic material.

BRIEF DESCRIPTION OF THE DRAWINGS

The invention is described below with reference to the attached drawings with the help of multiple embodiments as examples. In the drawings.

DESCRIPTION OF PREFERRED EMBODIMENTS

Figure 1:
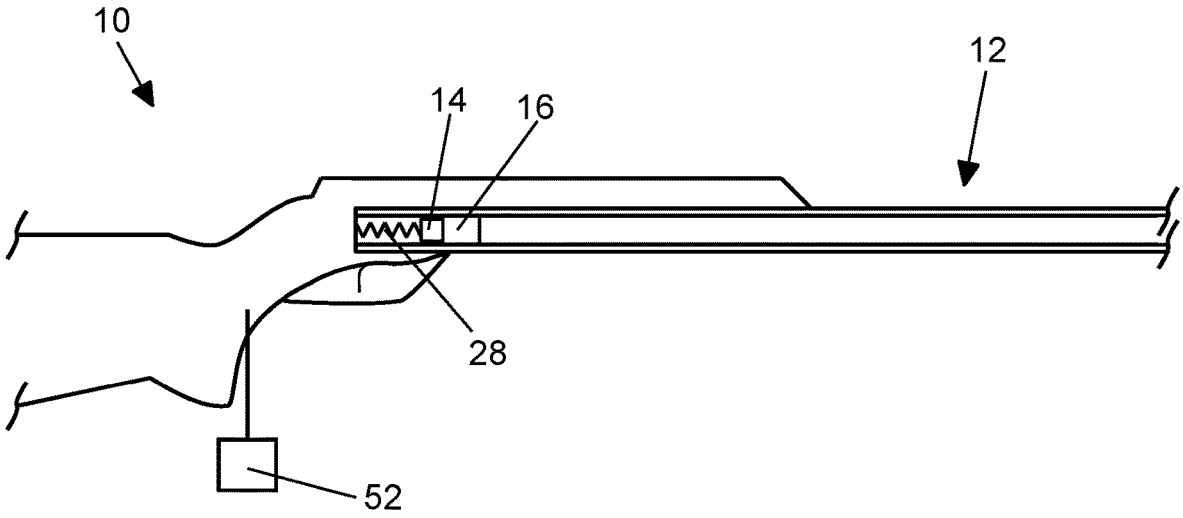
FIG. 1 shows a perspective view of a firearm according to the invention.
Figure 2:
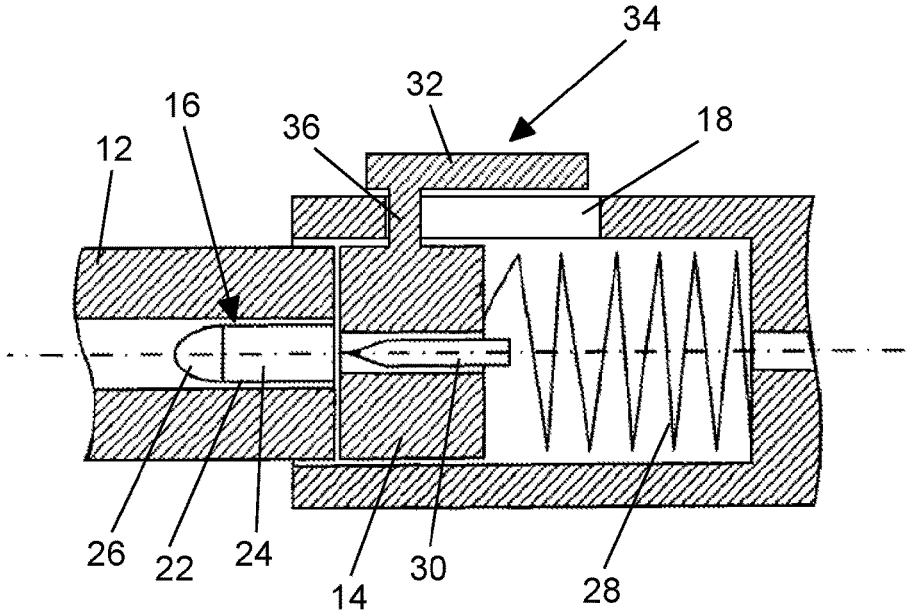
FIG. 2 shows a schematic diagram of a detail of a first embodiment of a firearm according to the invention, wherein a breech body is shown in the closed position.
Figure 3:
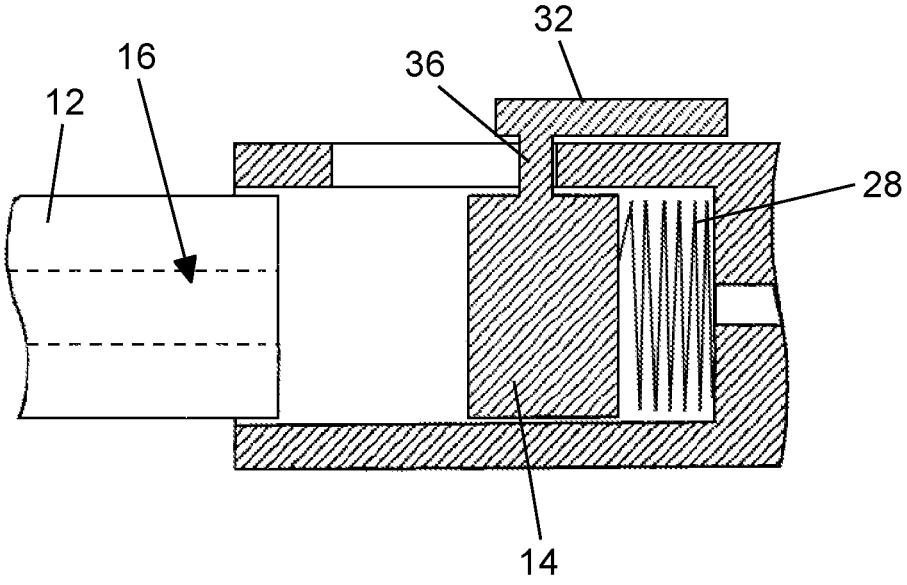
FIG. 3 shows the schematic diagram of the detail in FIG. 2, wherein the breech body is shown in the open position.

While a perspective view of a firearm 10 according to the invention is shown in FIG. 1, a partial view of a first embodiment of a firearm 10 according to the invention is depicted in FIGS. 2 and 3. The firearm 10 has a barrel 12 and a breech body 14. The rear portion of the barrel 12 is designed as a cartridge chamber 16. The breech body 14 is arranged such that it can move in the longitudinal direction of the barrel 12 in a breech guide 18 between the closed position shown in FIG. 2 and the open position shown in FIG. 3. The cartridge chamber 16 is provided to hold a cartridge 20 which comprises a cartridge case 22, a propellant 24 arranged in the cartridge case 22, and a projectile 26.

In the closed position shown in FIG. 2, the breech body 14 forms an opposing bearing or counter support or support for absorbing the recoil or kickback produced in the cartridge chamber 16 when the propellant 24 of the cartridge 20 is ignited. When the propellant 24 of the cartridge 20 is ignited, the projectile 26 is driven through the barrel 12 in the longitudinal direction thereof, while the cartridge case 22 is held in the cartridge chamber 16 by the breech body 14 (due to the mass inertia thereof) against the explosion pressure of the propellant 24.

After the shot has been fired, the breech body 14 is moved back against the force of an elastic element in the form of a closing spring 28 into the open position shown in FIG. 3 by the recoil which is produced. The closing spring 28 in this case is primarily used to move the breech body 14 subsequently back from the open position into the closed position, but it also supports the remaining of the breech body 14 in the closed position while the shot is being fired. During the movement of the breech body 14 into the open position, or when said open position has been reached, the cartridge case 22 is ejected from the weapon, so that a new cartridge 20 can then be automatically inserted into the cartridge chamber 16.

In order to ignite the propellant 24 of the cartridge 20, and therefore to fire a shot, a firing pin 30 strikes a primer cap arranged in the center of the rear face of the cartridge 20, wherein alternatively to this, rimfire ignition, or another kind of ignition, of the propellant 24 is conceivable, for which purpose the firing pin 30 does not strike the cartridge 20 in the center of the rear side, but offset from the center, or also a type of ignition in which no firing pin 30 is required, for example an electrically-based ignition, etc.

The firearm 10 has a mass simulation body 32 in force-fitting engagement with the breech body 14, in the embodiments described here a mass simulation body 32 rigidly connected to the breech body 14. The mass simulation body 32 in the embodiments described here is arranged outside the breech guide 18, for which purpose said breech guide has a recess 34 in which a connection element 36 which rigidly connects the mass simulation body 32 to the breech body 14 is movably arranged or mounted. In order to avoid pressure losses of the recoil, the connection element 36 is connected to a seal which covers the recess 34, so that no, or only minimal, pressure losses occur.

In alternative embodiments, a flexible connection between the breech body 14 and mass simulation body 32 is also conceivable, for example. The mass simulation body 32 has a rod-shaped or plate-shaped design and has two flat sides (underside, upper side, in alternative embodiments at least one flat side).

Figure 4:
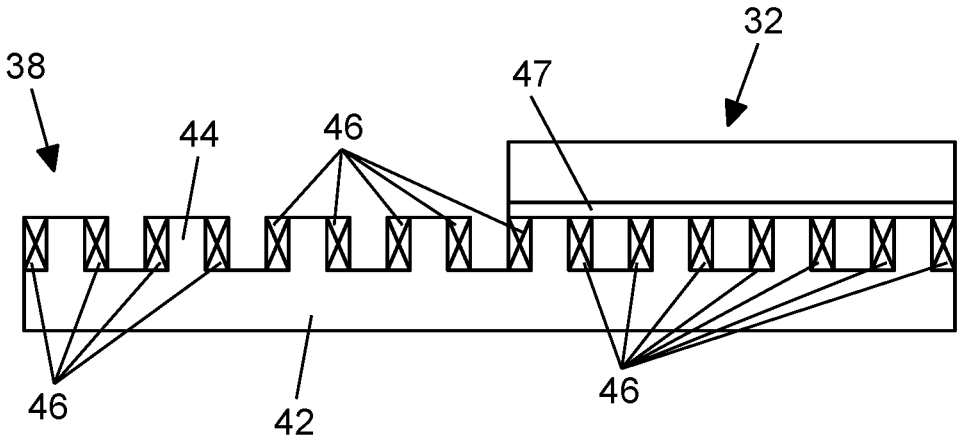
FIG. 4 shows a sectional depiction which shows a mass simulation body and an electromagnet arrangement of the first embodiment.

Furthermore, the firearm 10 has multiple electromagnets which are configured in a line-shaped or linear arrangement. The electromagnets 38 are arranged linearly in the manner of a BLDC linear stator, i.e. the arrangement of the electromagnets 38 exhibits a comb-shaped rail or comb rail 40 which has a base rail 42 and cylindrical teeth 44 extending perpendicularly therefrom (cf. in particular FIG. 4 in this respect, which shows a sectional depiction of the mass simulation body 32 and the electromagnets 38). The teeth 44 are each surrounded or wrapped by a coil 46 (magnet winding or magnetic coil), so that each tooth 44 forms an electromagnet 38 with the coil 46 assigned to it. In an alternative embodiment, only one electromagnet 38 would also be conceivable.

The comb rail 40 is formed in its entirety from an iron alloy, i.e. the base rail 42 and the teeth 44 are formed from an iron alloy. In alternative embodiments, the base rail 42 and the teeth 44 are formed from an alternative material which is suitable as the core for an electromagnet. In further alternative embodiments, only the teeth 44 may be made from an iron alloy, a ferrous material or an alternative material which is suitable as the core for an electromagnet, while the base rail 42 is formed from any kind of material.

The mass simulation body 32 and the electromagnets 38 are arranged relative to one another in such a manner that in a state in which at least one electromagnet 38 produces a magnetic field, the mass simulation body 32 is attracted by the magnetic field of the electromagnet(s) 38 supplied with power. In other words, the mass simulation body 32 is arranged in the effective range of the electromagnet(s) 38, in particular in the immediate vicinity of the electromagnet(s) 38. In the embodiments described here, the mass simulation body 32 is provided on its underside, i.e. its side facing the electromagnets 38, with a slide element 47, with which it rests on the teeth 44 of the comb rail 40. Alternatively to this, it is also conceivable for a sliding element to be arranged on the comb rail 40. This serves to reduce friction during the movement of the mass simulation body 32.

The mass simulation body 32 in the first embodiment (cf. for example FIG. 4 in this respect) is produced in its entirety (alternatively to this, at least in parts) from a material that can be magnetized by a magnetic field, in the present case from an iron alloy. Other materials also provide possible alternatives to this which can experience attraction by a magnetic field, for example (other) ferromagnetic or ferrimagnetic materials.

It is possible to counteract the action of the closing spring 28, i.e. the force caused by the closing spring 28, through energization of the electromagnets 38, so that the closing movement of the breech body 14 is thereby slowed down (for example for ventilation purposes of the barrel of the firearm 10). For this purpose, energization with roughly 10% of the maximum magnetic current or the maximum current intensity is conceivable, but also with currents such as 5% to 40%, in particular 5% to 25%, furthermore particularly 5% to 15%, of the maximum current intensity, for example.

Figure 5:
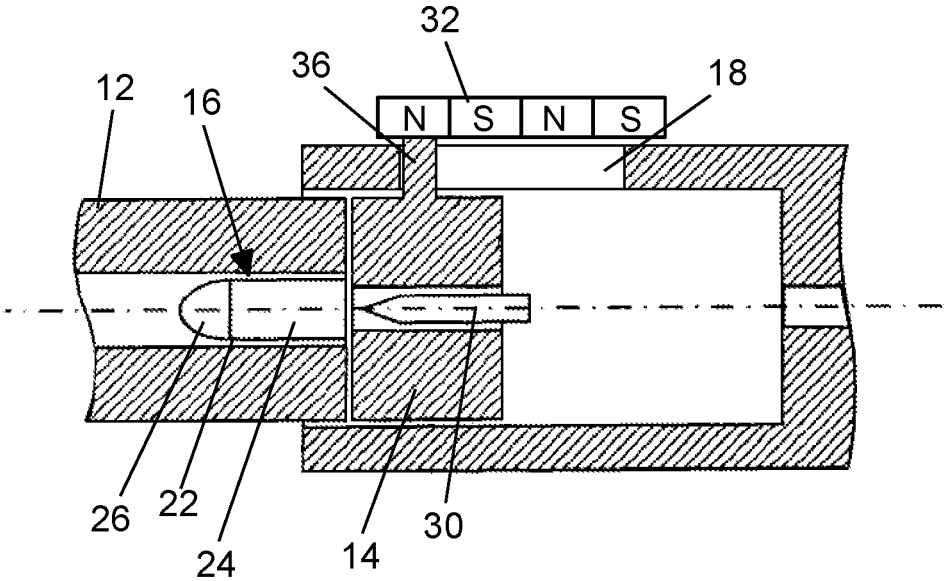
FIG. 5 shows a schematic diagram of a detail of a second embodiment of a firearm according to the invention, wherein the breech body is in turn shown in the closed position.
Figure 6:
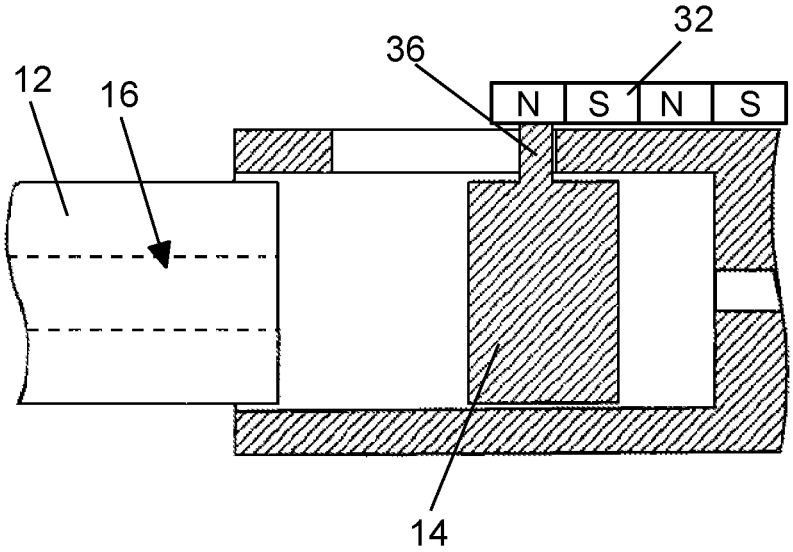
FIG. 6 shows the schematic diagram of the detail of the firearm in FIG. 5, wherein the breech body is shown in the open position.
Figure 7:
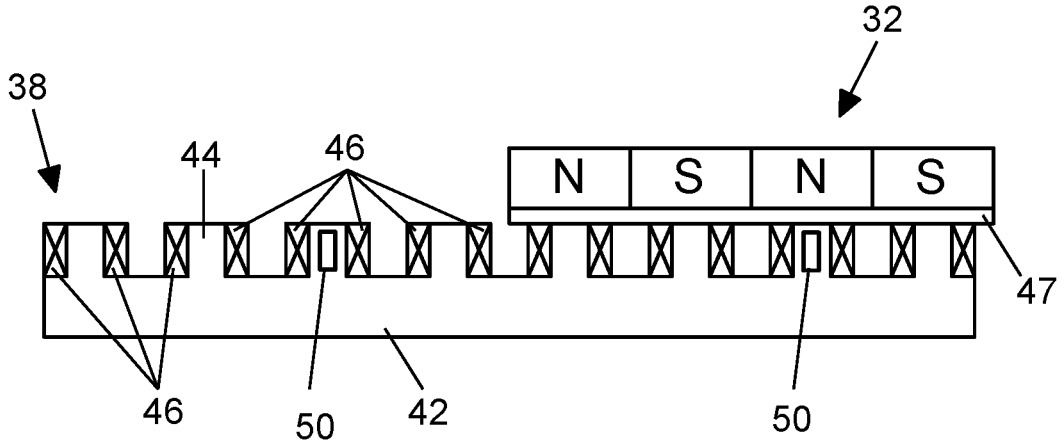
FIG. 7 shows a sectional depiction which shows a mass simulation body and an electromagnet arrangement of the second embodiment.

In a second embodiment which is shown in FIGS. 5 to 7, the mass simulation body 32 is composed of a plurality of magnets (permanent magnets 48 in the embodiment described, although electromagnets would also be conceivable). Through a corresponding change in the energization or power supply of the individual electromagnets 38, apart from an attracting effect for attraction of the mass simulation body 32 to the electromagnets 38, a repellent effect can be achieved on the permanent magnets 48, i.e. the mass simulation body 32, in each case, so that the mass simulation body 32 can be moved by magnetic fields of the individual electromagnets 38 which are synchronized accordingly. This may, in particular, bring about the movement of the breech body 14 from its open position into its closed position, and thereby replace the action of the closing spring 28 which is present in the first embodiment.

The closing spring 28 is not therefore present in the second embodiment described here, but it is also conceivable in alternative embodiments that said closing spring is present in addition.

It is also possible in these alternative embodiments (second embodiment with additional closing spring 28), to counteract the action of the closing spring 28, i.e. the force caused by the closing spring 28, through an energization of the electromagnets, so that the closing movement of the breech body 14 is thereby slowed down (for example for ventilation purposes of the barrel of the firearm 10). The current intensities for energizing the electromagnets 38 are the same as those mentioned above in the description of the first embodiment.

The mass simulation body 32 and the electromagnets 38 form a BLDC linear motor in the second embodiment, in other words, they are arranged in the manner of a BLDC linear motor, in order to achieve the movement of the mass simulation body 32 described in greater detail above through the magnetic fields of the electromagnets 38. The movement can take place both in a direction from the open position of the breech body 14 into its closed position, and also in a direction from the closed position of the breech body 14 into its open position. Moreover, the second embodiment corresponds to the first embodiment described above.

The firearm 10 has position sensors 50, in order to detect the position of the mass simulation body 32. In the first embodiment, these are configured as optical sensors, although other kinds of sensors, such as induction sensors or Hall sensors, for example, which are used in the second embodiment, can also be used. The position sensors are arranged on the mass simulation body 32 in the first embodiment, while in the second embodiment they are arranged on the comb rail 40.

In the embodiments described, the firearm has an open-loop control 52 (as an alternative to this, a closed-loop control), which is designed or has a corresponding set of instructions to adjust a maximum power supply to at least one, in particular all, of the multiple electromagnets 38 for a given period of time when the breech body 40 is in the closed position, in order to achieve an increased mass or effective mass ("simulated mass") of the mass simulation body 32, and therefore of the breech body 14, when a shot is fired.

The open-loop control 52 is further designed, or has a corresponding set of instructions, to adjust a maximum power supply to at least one, in particular all, of the multiple electromagnets 38 for a given period of time when the breech body 14 is in the open position, so that the breech body 14 is thereby held in its open position and the cartridge chamber 16 and the barrel 12 of the firearm 10 experience improved cooling. It is conceivable in this case to blow a coolant, in particular air, into the cartridge chamber 16 and/or the barrel 12 of the firearm 10 when the breech body 14 is in the open position.

Furthermore, the open-loop control 52 is designed, or has a corresponding set of instructions, to activate or supply power to one or multiple electromagnets 38, depending on the position of the firing pin 30. For this purpose, the firearm 10 has a position sensor for the firing pin 30 which conveys the position thereof to the open-loop control. In this way, the open-loop/closed-loop control of the electromagnets 38 can, in particular, take place precisely in the time range of the firing of the shot.

In embodiments in which the firearm has a closing spring 28, the open-loop control 52 is, in addition, designed, or has a corresponding set of instructions, to adjust a fraction, preferably a predetermined fraction, of the maximum power supply to the one, or at least one, in particular all, of the multiple electromagnets 38 for a given period of time during a time period of a movement of the breech body 14 from its open position into its closed position, so that the spring force of the closing spring 28 can thereby be counteracted. It is conceivable for the predetermined fraction of the maximum power supply to increase with the increasing temperature of the barrel 12 and/or of the breech body 14 of the firearm 10, so that an increasing cooling of the respective components can be achieved through a slowing of the movement of the breech body 14 from its open position into its closed position. For this purpose, it is conceivable for temperature sensors to be arranged on the respective components of the firearm 10, or in the vicinity thereof.

In the first embodiment and all alternative embodiments thereto, in which the mass simulation body 32 is not produced from a permanent-magnetic material, the open-loop control 52 is also designed, or has a corresponding set of instructions, to adjust a power supply to at least one, in particular all, of the multiple electromagnets 38 for the demagnetization of the arrangement, in particular the arrangement of electromagnets 38 and the mass simulation body 32.

In particular, in the second embodiment of the firearm the electromagnets 38 are designed for a supply with rotating current, as a result of which continued movement of the breech body 14, in particular, especially a movement of the same from the open position into the closed position, can be effectively brought about by means of the action of the magnetic fields produced by the electromagnets 38.

Although the invention is described with the help of embodiments with fixed combinations of features, it nevertheless also comprises the conceivable further advantageous combinations, as they are indicated in particular, but not exhaustively, by the dependent claims. All features disclosed in the application documents are claimed as essential to the invention, insofar as they are novel in respect of the prior art, either individually or in combination.

The invention claimed is:

1. A semiautomatic or fully automatic firearm comprising a barrel, the rear barrel end whereof is in the form of a cartridge chamber into which a cartridge can be inserted;

a breech body which is arranged such that it can move in the longitudinal direction between an open position, which releases the cartridge chamber for the reloading of the cartridge, and a closed position which closes the cartridge chamber, wherein the breech body closes the cartridge chamber at the rear in the closed position and is used as a support for the cartridge case of the cartridge, the firearm has a mass simulation body which is in force-fitting engagement with the breech body, the mass simulation body being formed at least in part from a magnetically susceptible material, and the firearm furthermore has at least one electromagnet to generate a magnetic field, a firing pin and a control that activates the at least one electromagnet depending on the position of the firing pin, wherein the mass simulation body is arranged in an effective region in order to move when the magnetic filed of the at least one electromagnet is generated.

2. The firearm as claimed in claim 1, wherein the firearm comprises multiple electromagnets and the electromagnets are arranged linearly as a BLDC (brushless linear direct current) linear stator, and wherein the multiple electromagnets include the at least one electromagnet.

3. The firearm as claimed in claim 1, wherein the firearm comprises multiple electromagnets and the mass simulation body is formed at least in part from a permanent-magnetic material, wherein the mass simulation body and the multiple electromagnets are arranged as a BLDC (brushless linear direct current) linear motor, and wherein the multiple electromagnets include the at least one electromagnet.

4. The firearm as claimed in claim 1, wherein the mass simulation body is plate-shaped.

5. The firearm as claimed in claim 1, wherein the firearm has an elastic element for moving the breech body from the open position into the closed position.

6. The firearm as claimed in claim 1, wherein a sliding element is arranged between the mass simulation body and the at least one electromagnet to reduce friction during movement of the mass simulation.

7. The firearm as claimed in claim 1, wherein the firearm comprises at least one position sensor for detecting the position of the mass simulation body.

8. The firearm as claimed in claim 1, wherein the firearm has a control that adjusts a maximum power supply to the at least one electromagnet for a given period of time when the breech body is in the closed position.

9. The firearm as claimed in claim 1, wherein the firearm has a control that adjusts a maximum power supply to the at least one electromagnet for a given period of time when the breech body is in the open position.

10. The firearm as claimed in claim 5, wherein the firearm has a control that adjusts a fraction of the maximum power supply to the at least one electromagnet for a given period of time.

11. The firearm as claimed in claim 1, wherein the firearm has a control that adjusts a power supply to the at least one electromagnet for the demagnetization of the at least one electromagnet and the mass simulation body.

12. The firearm as claimed in claim 1, wherein the firearm comprises multiple electromagnets, the at least one electromagnet being one of the multiple electromagnets, and wherein the firearm has a control that supplies power to each one of the multiple electromagnets individually and independently of the other electromagnets in terms of timing in such a manner that the mass simulation body is moved in the closing direction by the resulting magnetic fields.

13. The firearm as claimed in claim 1, wherein the firearm has multiple electromagnets and the electromagnets are activated by alternating current.

14. The firearm as claimed in claim 1, wherein the mass simulation body is rigidly connected to the breech body.

15. The firearm as claimed in claim 1, wherein the mass simulation body is formed at least in part from a ferromagnetic material, a ferrimagnetic material, or a permanent-magnetic material.

16. The firearm as claimed in claim 1, wherein the firearm has a closing spring for moving the breech body from the open position into the closed position.

17. The firearm as claimed in claim 1, wherein the firearm has a control which adjusts a fraction of the maximum power supply to the at least one electromagnet for a period of time of a movement of the breech body from its open position into its closed position.

18. The firearm as claimed in claim 1, wherein the firearm comprises multiple electromagnets, the at least one electromagnet being one of the multiple electromagnet, and wherein the firearm has a control that supplies power to each one of the multiple electromagnets individually and independently of the other electromagnets in terms of timing in such a manner that the mass simulation body is moved into the closed position by the resulting magnetic fields.

19. The firearm as claimed in claim 1, wherein the mass simulation body is rod-shaped with at least one flat side which faces the at least one electromagnet.

* * * * *